US006557828B2

(12) United States Patent
Yamamoto

(10) Patent No.: US 6,557,828 B2
(45) Date of Patent: May 6, 2003

(54) PNEUMATIC MOTOR AND PNEUMATIC HOIST APPARATUS INSTALLED WITH THE SAME

(75) Inventor: Katsuji Yamamoto, Saga (JP)

(73) Assignee: Toku Pneumatic Tool Mfg. Co., Ltd., Saga (JP)

( * ) Notice: Subject to any disclaimer, the term of this patent is extended or adjusted under 35 U.S.C. 154(b) by 0 days.

(21) Appl. No.: 09/851,183

(22) Filed: May 8, 2001

(65) Prior Publication Data

US 2002/0074539 A1 Jun. 20, 2002

(30) Foreign Application Priority Data

Dec. 18, 2000 (JP) ..... 2000-384405

(51) Int. Cl.[7] ..... B66D 1/22; B66D 1/10
(52) U.S. Cl. ..... 254/344; 254/360; 254/372
(58) Field of Search ..... 254/360, 344, 254/372, 378

(56) References Cited

U.S. PATENT DOCUMENTS 793,561 A * 6/1905 Bolthoff ..... 254/340
2,901,219 A * 8/1959 Bottje et al. ..... 212/197
4,566,675 A * 1/1986 Kotone et al. ..... 254/360
5,370,367 A * 12/1994 Zaguroli, Jr. ..... 254/360
5,725,199 A * 3/1998 Yamamoto ..... 254/360
6,427,982 B1 * 8/2002 Sugimachi ..... 254/360

* cited by examiner

*Primary Examiner*—Kathy Matecki
*Assistant Examiner*—Evan Langdon
(74) *Attorney, Agent, or Firm*—Jordan and Hamburg LLP

(57) ABSTRACT

A pneumatic motor is provided with twin cylinders each with a piston installed therein slidably, disposed horizontally adjacent in a direction parallel to axis of a motor shaft interposed between the twin cylinders and arranged in a direction intersecting with the twin cylinders at a right angle. An association system couples the motor shaft to each piston and is arranged so as to convert a linear movement of each piston into a rotational movement and transmit the rotational movement to the motor shaft. The twin cylinders, the motor shaft and the association system are disposed integrally in a casing. The association system has each of a first eccentric shaft and a second eccentric shaft, which in turn are disposed projecting from the motor shaft in opposite directions at a phase angle of 90 and coupled with a first eccentric pin and a second eccentric pin in an eccentric state, which in turn are coupled in association with the respective pistons. A pinion gear is disposed in mesh with a ring gear mounted integrally in a motor chamber on an outer periphery of the first eccentric shaft and the second eccentric shaft, respectively.

10 Claims, 9 Drawing Sheets

PNEUMATIC MOTOR AND PNEUMATIC HOIST APPARATUS INSTALLED WITH THE SAME

CROSS-REFERENCE TO RELATED APPLICATION

The entire disclosure of Japanese Patent Application No. 2000-384,405 filed on Dec. 18, 2000, including specification, claims and summary is incorporated by reference in its entirety.

BACKGROUND OF THE INVENTION

1. Field of the Invention

The present invention relates to a pneumatic motor and a pneumatic hoist apparatus installed with the pneumatic motor.

2. Description of the Related Art

Hitherto, a pneumatic hoist apparatus is generally comprised of a drive portion consisting of a pneumatic motor and a decelerating mechanism, a brake portion consisting of a rotary abrasion plate, a pressure spring and a release cylinder, a control portion consisting of a valve mechanism for controlling a drive portion and a brake portion, and a winding portion consisting of a chain and a wheel.

The pneumatic motor of the pneumatic hoist apparatus may generally comprise a vane motor, an axial piston motor or a radial piston motor. Out of these pneumatic motors, the vane motor has a lower level of abrasion at a rotary seal part of a cylinder chamber and allows rotation at a higher speed, as compared with the piston motors. The piston motors have a larger level of abrasion at a piston seal part, as compared with the vane motor, so that it is less suitable for rotation at a high speed. It has the advantage, however, that the cylinder chamber can be readily rendered airtight and volume efficiency can become great. Further, it can readily make the effective pressure receipt area of the cylinder chamber greater so that the pneumatic motor itself can be easily provided with torque at a high output.

Each of the pneumatic motors, however, suffers from the following disadvantages.

The vane motor has the defect that its mechanical efficiency is low. For example, it is so difficult to raise the air tightness of its cylinder chamber. Further, it is also difficult to increase an effective pressure receipt area of the cylinder chamber. Therefore, it is required to rotate its pneumatic motor at a high speed in order to gain a high output torque and to use the pneumatic motor in combination with a deceleration mechanism having a high deceleration ratio. Moreover, it has the defects that air may be leaked and noises may be caused due to rotation at a high speed.

On the other hand, the conventional piston motors require the installation of a crank mechanism or a swash plate mechanism for converting a linear movement of a piston into a rotational movement of its motor shaft. This leads to an increase in resistance to abrasion resulting in a low mechanical efficiency.

As described above, each of the vane motor and the piston motor has its merits and demerits, although the vane motor is leading the piston motor based on its advantage of manufacturing costs.

The vane motor, however, still has the problems with from preservation of the environment, labor circumferences, etc. To saving energy and rendering noises lower. Therefore, the development of a pneumatic hoist apparatus with a pneumatic motor has been demanded, which can solve the above problems as well as increase mechanical efficiency has been demanded.

SUMMARY OF THE INVENTION

The present invention has the object to provide a pneumatic motor that can solve the disadvantages inherent in the conventional motors.

The present invention has another object to provide a pneumatic hoist apparatus installed with the pneumatic motor that can solve the disadvantages of the conventional motors.

In order to achieve the object, the present invention in one aspect provides a pneumatic motor comprising twin cylinders each with a piston installed slidably therein and disposed horizontally adjacent in a direction parallel to an axis of a motor shaft interposed between the twin cylinders and disposed in a direction intersecting with each of the twin cylinders at a right angle. An association unit connects the motor shaft to each of the pistons and is adapted to convert a liner movement of each of the pistons into a rotational movement and transmit the rotational movement to the motor shaft. The twin cylinders, the motor shafts and the association unit are installed integrally in a casing. The association system is coupled with end an portion of each of a first eccentric shaft and a second eccentric shaft, which in turn are disposed projecting from the motor shaft in opposite directions at a phase angle of 90 and coupled with a first eccentric pin and a second eccentric pin in an eccentric state, which in turn are coupled in association with the respective pistons. A pinion gear is disposed in mesh with a ring gear mounted integrally in a motor chamber on an outer periphery of the first eccentric shaft and the second eccentric shaft.

In a preferred embodiment, the present invention provides the pneumatic motor in which the first eccentric shaft and the second eccentric shaft are connected to the center of the piston shaft with a piston disposed at each of the both ends thereof.

In a more preferred embodiment, the present invention provides the pneumatic motor in which the diameter of a pitch circle of the pinion gear disposed on each of the first eccentric shaft and the second eccentric shaft is set to twice the amount of eccentricity from the motor shaft of each of the first eccentric shaft and the second eccentric shaft and the diameter of a pitch circle of the pinion gear disposed on each of the first eccentric shaft and the second eccentric shaft is set to double the amount of eccentricity of the first and second eccentric shafts, while the axial center of the eccentric pin disposed on each of the eccentric shafts is located on a periphery of the pitch circle of the pinion gear.

In a more preferred embodiment, the present invention provides the pneumatic motor in which, as the axial center of one of the first and second eccentric pins reaches a periphery of the pitch circle of the ring gear, the axial center of the other eccentric pin is arranged so as to simultaneously reach the central position of the pitch circle of the ring gear.

The present invention in another aspect provides a pneumatic hoist apparatus installed with the pneumatic motor in each of the embodiments as described above, in which a motor control chamber is disposed under the cylinders, the motor shafts and the association system are disposed in the casing of the pneumatic motor, and a valve mechanism system is disposed in the motor control chamber and is so adapted as to rotate the pneumatic motor in normal and opposite directions by controlling the supply of air to the pneumatic motor and the discharge of air therefrom. A chain sprocket is coupled with the motor shaft with the aid of a gear and is disposed in a direction parallel to the axis of the motor shaft and with a chain wound thereon, the chain being mounted on the chain sprocket with a hook for hoisting goods or the like at its bottom end.

In a preferred embodiment of the another aspect, the present invention provides the pneumatic hoist apparatus having a remote control portion disposed nearby above the hook for hoisting goods or the like, from which the operations for rotating the pneumatic motor in normal and reverse directions and for terminating the rotation of the pneumatic motor can be controlled Other objects, features and advantages will become apparent in the course of the following description with reference to the accompanying drawings.

BRIEF DESCRIPTION OF THE ACCOMPANYING DRAWINGS

Figure 1:
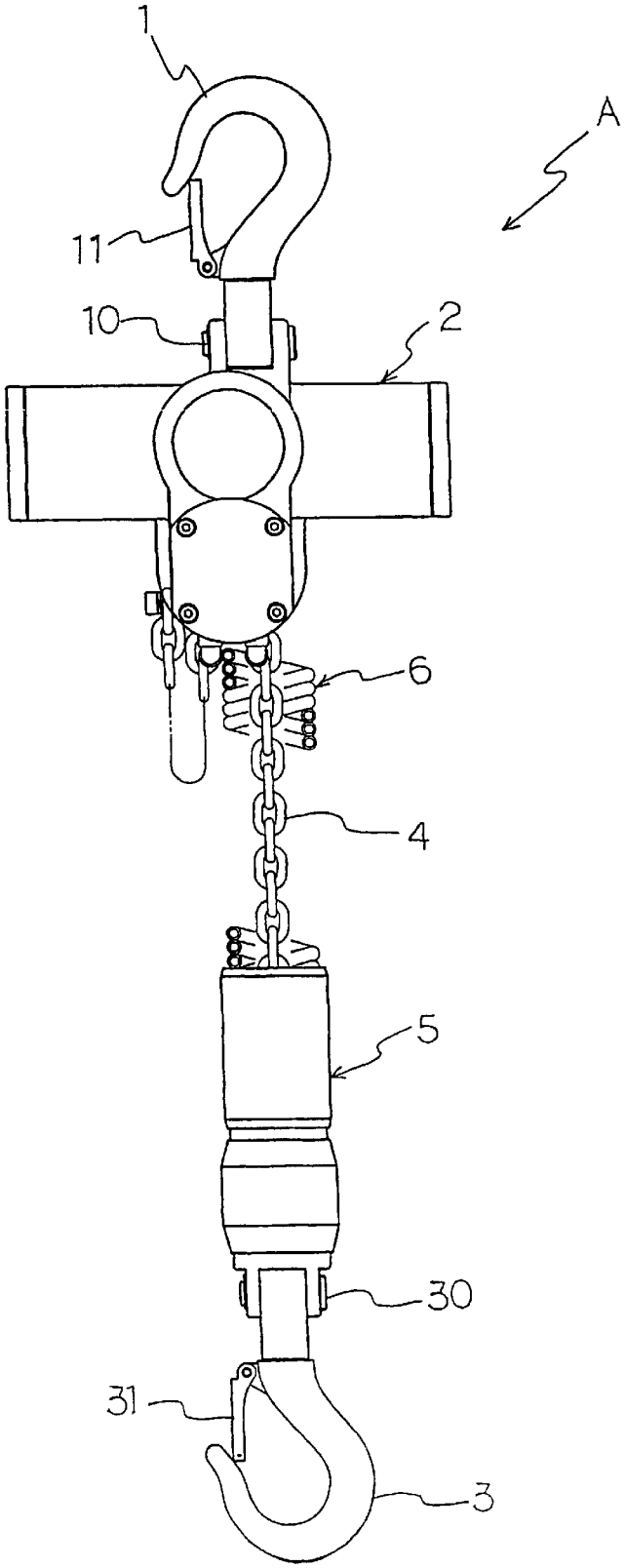
FIG. 1 is a front view showing a pneumatic hoist apparatus in accordance with an embodiment of the present invention.

FIGS. 9*a*–9*h* are schematic views showing the direct-acting status of a piston member.

DESCRIPTION OF THE PREFERRED EMBODIMENTS

The present invention according to the embodiment of the present invention will be described in more details.

The present invention comprises a pneumatic motor and a pneumatic hoist apparatus installed with the pneumatic motor.

The pneumatic motor may comprise twin cylinders each having a piston mounted slidably therein, a motor shaft and an association unit, the twin cylinders being disposed horizontally parallel to the axis of the motor, the motor shaft interposed between the twin cylinders in the direction intersecting with the cylinder at a right angle, and the association unit connecting the motor shaft to each of the pistons and converting a linear movement of each piston into a rotational movement and transmitting the rotational movement to the motor shaft.

The association system may be configured such that a first eccentric pin and a second eccentric pin, coupled with the corresponding pistons, respectively, are coupled with the both end portions of each of a first eccentric shaft and a second eccentric shaft disposed at a phase difference of 90 and projecting from the motor shaft in opposite directions, and that a pinion gear disposed on an outer periphery of each of the first eccentric shaft and the second eccentric shaft is in mesh with a ring gear disposed integrally in the casing.

In the configuration of the association system as described above, the diameter of a pitch circle of the pinion gear disposed on each of the first eccentric shaft and the second eccentric shaft is set so as to become twice the amount of eccentricity from the motor shaft of each of the first eccentric shaft and the second eccentric shaft and the axial center of the eccentric pin disposed on each of the eccentric shafts is arranged so as to be located on a periphery of the pitch circle of the pinion gear. This allows a smooth conversion of a linear movement of the piston into a rotational movement by applying a Cardan circle.

Therefore, the pneumatic motor according to the present invention can convert the linear movement of the piston into the rotational movement of the motor shaft, without installing a crank mechanism or a swash plate mechanism as required by the conventional piston motors. Further, the pneumatic motor causes no or less decrease in mechanical efficiency due to an increase in resistance to abrasion. Further, this configuration can render the motor small in size.

Moreover, the pneumatic motor according to the present invention can take advantage of the merits inherent in the conventional piston motors. For instance, such features include that the air tightness of the piston is high, stable features of rotation at a crawling speed can be readily gained, and the operation can be carried out at a low noise level because the rotation is low.

In addition, the pneumatic motor according to the present invention is configured such that, when the axial center of one of the first and second eccentric pins reaches a periphery of the pitch circle of the ring gear, the axial center of the other eccentric pin is arranged so as to simultaneously reach the central position of the pitch circle of the ring gear and that a change point of one of the pistons can exceed the rotational force of the other piston, thereby achieving a smooth rotation without any change point in entirety.

The first and second eccentric shafts may be connected to the center of each piston shaft and a piston may be mounted each on the both ends of the piston shaft.

More specifically, the pneumatic motor according to the present invention can achieve a smooth rotational movement by arranging the twin cylinders, each with each the cylinder installed therein, in parallel to each other and setting the rotational angle of each one piston to 90.

Therefore, the pneumatic motor having the above configuration can be appropriately applied to the pneumatic hoist apparatus according to the present invention.

The pneumatic hoist apparatus according to the present invention may be configured such that a motor control chamber is disposed under the casing with the twin cylinders, the motor shafts and the association system installed therein; the motor control chamber is provided with a valve mechanism for controlling the normal and reverse rotation of the pneumatic motor by controlling the supply of air to the pneumatic motor or the discharge of air therefrom; a chain sprocket coupled with the motor shaft through a gear is disposed parallel to the axis of the motor shaft, and a chain installed with a hook for hoisting goods or the like is wound on the chain sprocket.

This configuration of the pneumatic hoist apparatus can render the main casing body compact in size, which is provided with the pneumatic motor, the valve mechanism and so on. Further, a higher output torque can be gained, as compared with a pneumatic hoist apparatus installed with the conventional vane motor. Moreover, the pneumatic hoist apparatus can be operated at a very low noise level, thereby ensuring an improved work environment:

In addition, favorable operability can also be ensured by arranging a remote control section disposed nearby above the hook for hoisting goods or the like, the remote control section being arranged so as to carry out the normal and reverse rotations of the pneumatic motor as well as to cease operating the rotation of the pneumatic motor.

A more detailed description is given below concerning the pneumatic motor and the pneumatic hoist apparatus with reference to the accompanying drawings.

Figure 2:
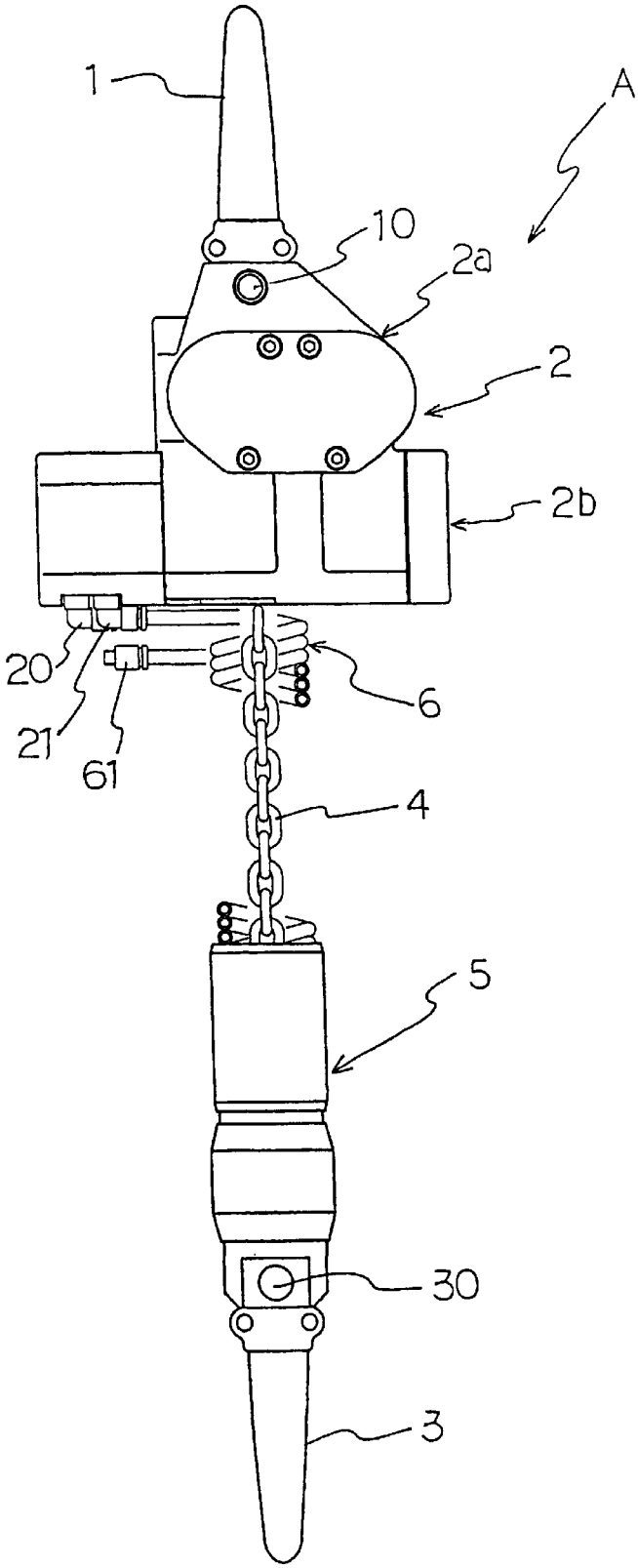
FIG. 2 is a side view showing the pneumatic hoist apparatus in accordance with an embodiment of the present invention.

FIG. 1 is a front view showing the entire outlook of the pneumatic hoist apparatus according to the embodiment of the present invention and FIG. 2 is a side view showing the entire outlook of the pneumatic hoist apparatus of FIG. 1.

As shown in FIGS. 1 and 2, a pneumatic hoist apparatus A according to an embodiment of the present invention comprises a main casing body 2 connected to an upper hook portion 1 supported on a ceiling or the like, a four-link chain 4 disposed so as to be lifted or lowered and having a lower hook portion 3 connected at its bottom end for hoisting goods or the like, an operating unit 5 disposed above the lower hook 3, and a motor control portion composed of a pneumatic motor M (FIG. 4) and a valve system and disposed in the main casing body 2. The upper hook portion 1 is connected to the main casing body 2 with a connecting pin 10 and provided with a lever 11 that can prevent the pneumatic hoist apparatus A itself from falling or detaching from the support. On the other hand, the lower hook portion 3 is connected to the operating unit 5 with a connecting pin 30 and provided with a lever 31 that can prevent the hoisted goods or the like from falling or detaching from the lower hook portion 3.

Figure 4:
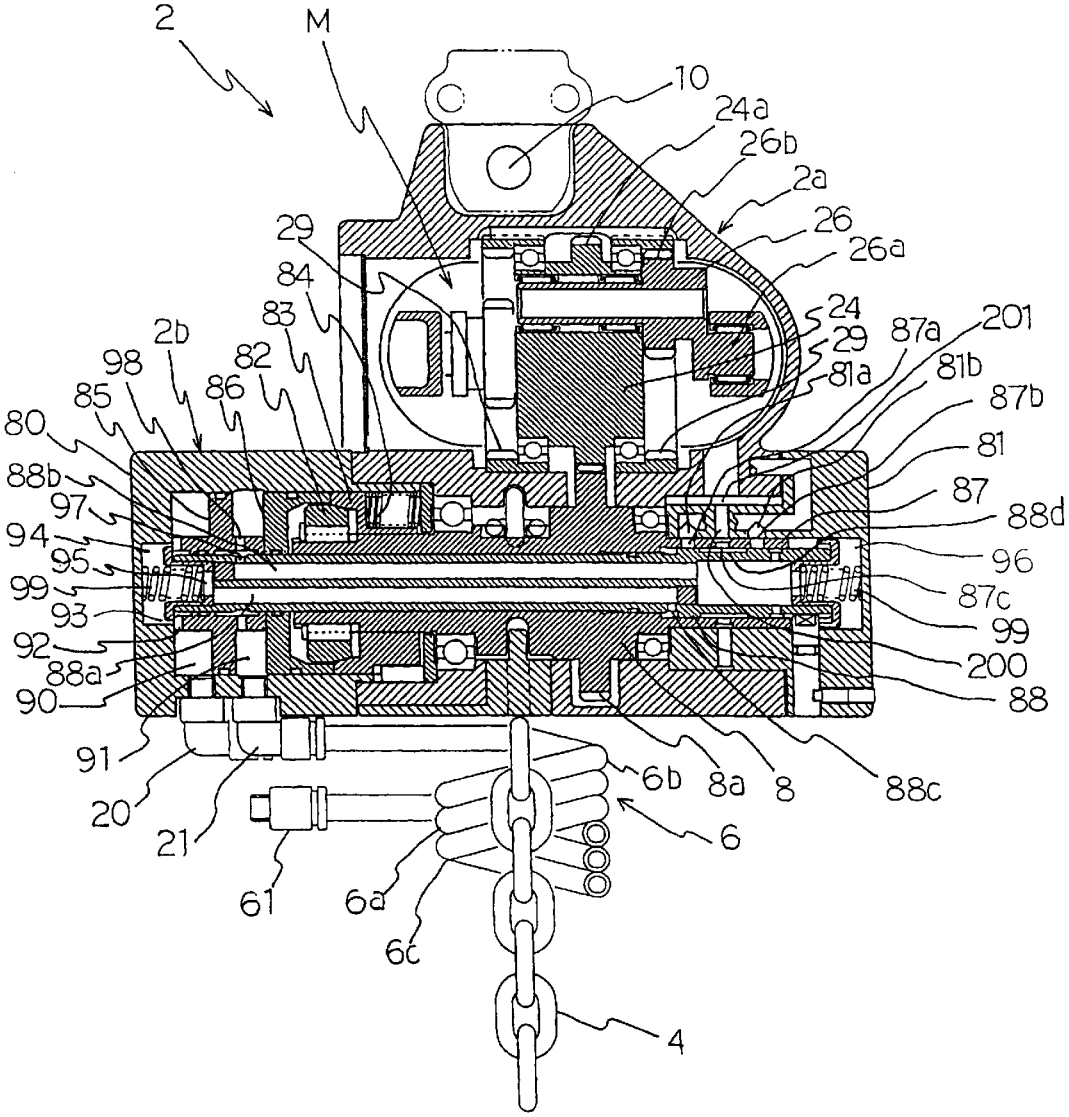
FIG. 4 is a sectional side view showing the pneumatic hoist apparatus in accordance with an embodiment of the present invention.
Figure 6:
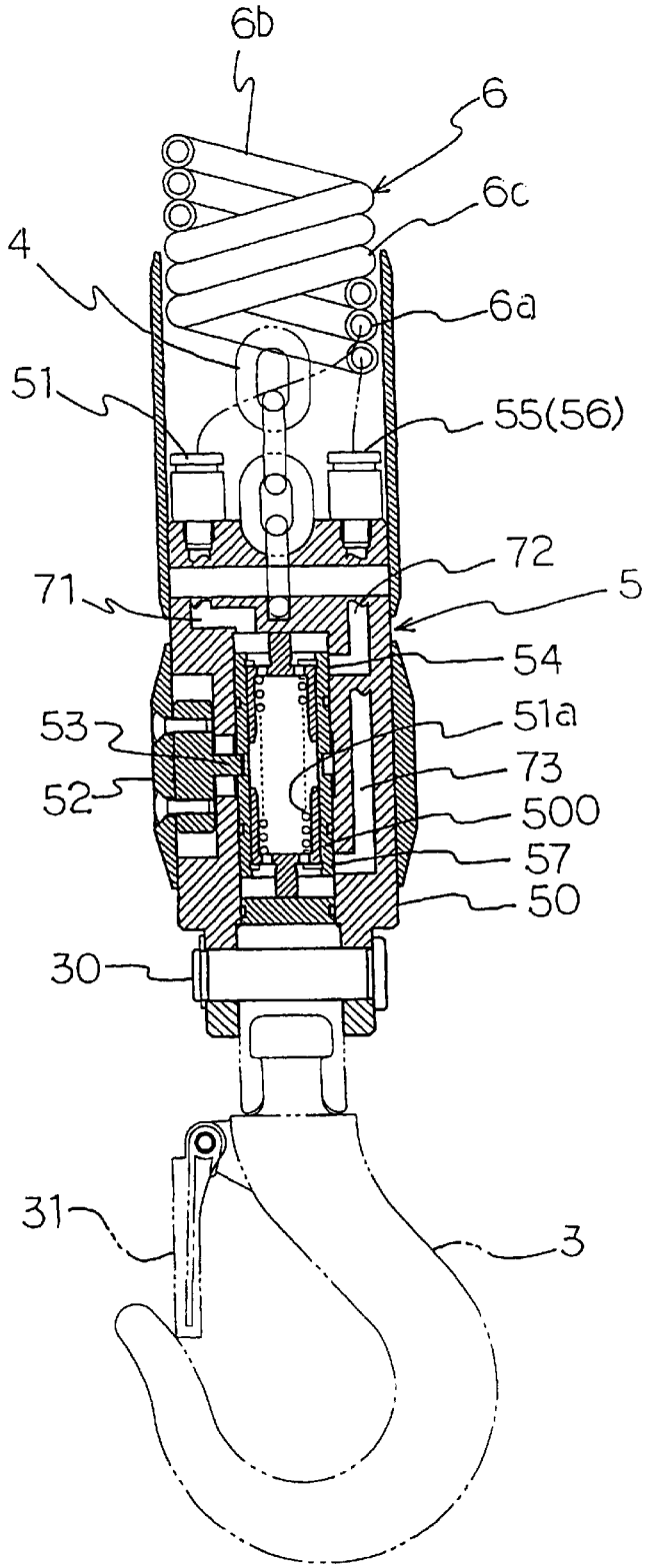
FIG. 6 is a sectional view showing an operating unit.

Reference numeral 6 sets forth a hose unit connected to the operating unit 5 and the main casing body 2 to supply air for driving the pneumatic motor M. The hose unit 6 may be composed of three hoses integrated with each other in a coiled state so as to expand and contract in upward and downward directions and disposed around the chain 4. One of the three tubes is used as a high pressure air supply tube 6*a* coupled with an air supply source (not shown) via a connector 61. The connector 61 is disposed at its bottom end portion, as shown in FIG. 4, and a connecting opening 51 for the supply of air disposed in the operating unit 5 at its opposite end, as shown in FIG. 6. This allows the high pressure air to be supplied from the air supply source to the main casing body 2 through communicating passages 71, 72 and 73, disposed in the operating unit 5, and the tubes 6*b* and 6*c* of the integrated three tubes 6 in a manner as will be described hereinafter.

The operating unit 5 is described below in more detail with reference to the accompanying drawings.

As shown in FIG. 6, the operating unit 5 has a direct-acting sleeve 500 disposed inside a valve body 50 so as to be slidable in upward and downward directions by the aid of a compressive coil spring 51*a* and a grip 52 disposed on an outer periphery thereof. The direct-acting sleeve 500 is coupled with an engagement piece 53 integrally connected to the grip 52. By sliding the grip 52 upwards or downwards by the hand of an operator, the direct-acting sleeve 500 moves upwards or downwards in association with the upward or downward sliding movement of the grip 52. More specifically, as the grip 52 is pushed upward, the direct-acting sleeve 500 moves upward, too, thereby allowing a port 54 at the normal rotation side disposed in the valve body 50 to be opened. Then, the high pressure air introduced from the connecting opening 51 is allowed to pass to a connecting opening 55 at the normal rotation side via the communicating passage 71 to the port 54 at the normal rotation side, followed by passage through the communicating passage 72 to the connecting opening 55 at the normal rotation side. Thereafter, the high pressure air flows through the tube 6*c* of the hose unit 6 and reaches an inlet 20 at the normal rotation side (see FIG. 4) disposed in the bottom face on a one side of the main casing body 2.

More specifically, when the pneumatic motor M is to be rotated in normal direction, the high pressure air is supplied from the high pressure air source through the high pressure air supply tube 6*a* of the hose unit 6 to the operating unit 5. Upon the supply of the high pressure air to the operating unit 5, the high pressure air enters into the operating unit 5 from the connecting opening 51 through the communicating passage 71 to the port 54 at the normal rotation side, followed by passage through the communicating passage 72 to the connecting opening 55 at the normal rotation side. The high pressure air is then supplied through the hose unit 6 (the tube 6*c*) to the main casing body 2 via the inlet 20 at the normal rotation side.

Once the hand of the operator releases the grip 52 at the operating position, the grip 52 is pulled back to its neutral position due to the action of the compressive coil spring 51*a* to close the port 54 at the normal rotation side and cease the supply of the high pressure air. Then, the grip 52 is returned to its initial position. By adjusting the amount of pushing the grip 52 upward, the opening area of the port 54 at the normal rotation side can be increased or decreased, thereby allowing a variable control of the flow rate of the high pressure air.

On the other hand, as the grip 52 is pushed downward, the direct-acting sleeve 500 is transferred downward to open a port 57 at the reverse rotation side disposed in the valve body 50.

As the port 57 at the reverse rotation side is opened, the high pressure air introduced from the connecting opening 51 for the high pressure air supply is allowed to flow through the port 57 at the reverse rotation side via the communicating passage 71, followed by passage through the communicating passage 73 to a connecting opening 56 at the reverse rotation side. After passage through the connecting opening 56 at the reverse rotation side, the high pressure air flows through the tube 6*b* of the hose unit 6 and is fed to an inlet 21 at the reverse rotation side (see FIG. 4) disposed in the bottom face on a one side of the main casing body 2. More specifically, the pneumatic motor M can be rotated in the reverse direction by first feeding the high pressure air from the air supply source to the operating unit 5 via the high pressure air supply tube 6*a* of the hose unit 6. In the operating unit 5, the high pressure air is supplied from the connecting opening 51 for the air supply through the communicating passage 71 to the port 57 at the reverse rotation side, followed by passage through the communicating passage 73 to the connecting opening 56 at the reverse rotation side. Then, the high pressure air flows from the connecting opening 56 at the reverse rotation side through the tube 6*b* of the hose unit 6 to the main casing body 2 via the inlet 21 at the reverse rotation side.

As the operating unit 5 is located in the vicinity of the lower hook 3 in the manner as described above, the pneumatic hoist apparatus A according to the present invention can hoist goods at a desired speed of raising or lowering while operating the operating unit 5.

Figure 5:
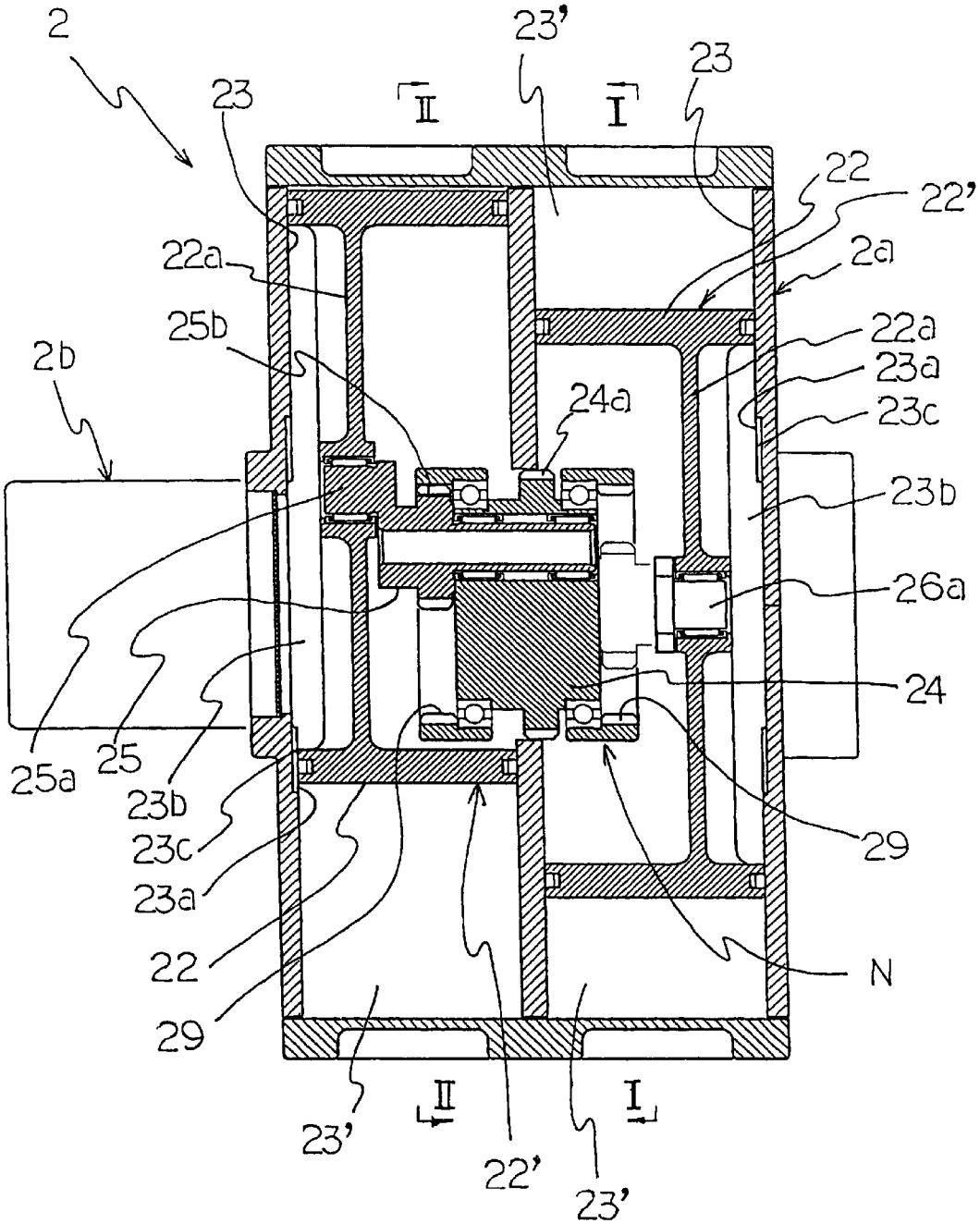
FIG. 5 is a sectional plan view showing the pneumatic hoist apparatus in accordance with an embodiment of the present invention.

As specifically shown in FIGS. 4 and 5, the pneumatic hoist apparatus according to the present invention is provided with the pneumatic motor M. The pneumatic motor M has pistons 22 and 22 disposed slidably in the twin cylinders 23 and 23, respectively, which are disposed horizontally adjacent parallel to the axis of the motor. Between the cylinders 23 and 23, a motor shaft 24 is interposed in a direction intersecting with the cylinders 23 and 23 at a right angle. Further, the motor shaft 24 is coupled with the pistons 22 and 22, and an association system N is disposed so as to transmit the rotational movement of the motor shaft 24 converted from the linear movement of each piston. The twin cylinders 23 and 23, the motor shaft 24 and the association system N are disposed integrally in the main casing body 2. Moreover, the association system N is coupled with the end portion of each of a first eccentric shaft 25 and a second eccentric shaft 26, which in turn are disposed projecting from the motor shaft 24 in opposite directions and disposed at a phase angle of 90 and coupled with a first eccentric pin 25*a* and a second eccentric pin 26*a* in an eccentric state, which in turn are coupled in association with the respective pistons 22 and 22. On the outer periphery of the first eccentric shaft 25 and the second eccentric shaft 26, respectively, pinion gears 25*b* and 26*b* are disposed in mesh with a ring gear 29 mounted integrally in the main casing body 2.

More specifically, as shown in FIG. 5, the main casing body 2 of the pneumatic hoist apparatus according to the embodiment of the present invention may comprise an upper casing section 2*a* and a lower casing section 2*b*. The upper casing section 2*a* may be provided with the twin cylinders 23 and 23 as well as the motor shaft 24, and the lower casing section 2*b* may be provided with a motor control part. The upper casing section 2*a* and the lower casing section 2*b* are assembled in a manner that the former crosses the latter at a right angle.

The upper casing section 2*a* is provided with the twin cylinders 23 and 23 which in turn are each installed slidably with a piston member 22' in a generally I-shaped form in longitudinal section. At the both ends of a piston shaft 22*a* of the piston member 22', motor pistons 22 and 22 are disposed, respectively. Between the piston shafts 22*a* and 22*a* of the I-shaped piston members 22', respectively, the motor shaft 24 is interposed slidably in a state crossing each motor piston 22 at a right angle with respect to its slidable direction. In the drawings, reference symbol 23*a* sets forth an intermediate exhaust port and reference symbol 23*b* sets forth an expansion chamber communicating with the outside through a path 23*c*.

The motor shaft 24 is provided with the first eccentric shaft 25 and the second eccentric shaft 26, which project in the opposite directions and are disposed on the same circumference at a phase angle of 90 with respect to the axial center of the motor shaft 24. At the end portion of each of the first eccentric shaft 25 and the second eccentric shaft 26, the first eccentric pin 25*a* and the second eccentric pin 26*a* are coupled in an eccentric state, respectively, so that the first eccentric pin 25*a* and the second eccentric pin 26*a* are coupled in association with the piston shaft 22*a* of each piston member 22'.

Further, the first eccentric shaft 25 and the second eccentric shaft 26 are provided coaxially with pinion gears 25*b* and 26*b*, respectively, each of which has a radius of a pitch circle which coincides with an amount of eccentricity of each of the first eccentric shaft 25 and the second eccentric shaft 26 with respect to the axial center of the motor shaft 24. The center of each of the first eccentric pin 25*a* and the second eccentric pin 26*b* is arranged so as to be located on the periphery of the pitch circle of each of the pinion gears 25*b* and 26*b*. Moreover, the ring gear 29 in mesh with the pinion gears 26*b* and 26*b* is fixed to the upper casing section 2*a*.

With the configuration as described above, as each of the pinion gears 25*b* and 26*b* rotates round the respective eccentric shafts 25 and 26 and on its axis, the locus of the center of each of the first eccentric pin 25*a* and the second eccentric pin 26*a* becomes linear. Therefore, the rotational movement of the motor shaft 24 can be converted into the linear movement of each of the motor pistons 22 and 22. In other words, in this case, the linear movement of each motor piston 22 can be converted into the rotational movement of the motor shaft 24 by the aid of the association system N, that is, the first eccentric shaft 25, the second eccentric shaft 26, the pinion gears 25*b* and 26*b* as well as the first eccentric pin 25*a* and the second eccentric pin 26*a*.

In addition, the piston member 22' is not composed of a single member, and two piston members 22' and 22' are coupled in association with the first eccentric shaft 25 and the second eccentric shaft 26 which have a phase difference of 90 with respect to each other. Therefore, as the center of one of the eccentric pins 25*a* and 26*a* reaches the pitch circle of the ring gear 29 on the locus on which the first eccentric shaft 25 and the second eccentric shaft 26 are arranged in a straight line, the center of the other eccentric pin 25*a* or 26*a* reaches the center of the ring gear 29. Therefore, the top dead center and the bottom dead center of the motor piston 22 of the one piston member 22', that is, the change point of the one piston member 22' can be exceeded by the driving force of the other piston member 22'.

In the embodiment of the present invention, only the thrust and the reaction force parallel to the linear locus can act on the motor pistons 22 and 22 as well as the first and second eccentric pins 25*a* and 26*a*, as described above, so that a pneumatic motor can be provided which has the characteristic of offsetting a variation in load, although such a variation in load cannot be avoided by a conventional pneumatic hoist apparatus that is adapted to wind up and unwind the chain 4.

As shown in FIG. 4, the four-link chain 4 is wound about a chain sprocket 8 that in turn is held in the lower casing section 2*b* and located coaxially with the motor shaft 24 under the motor shaft 24 disposed at a generally central portion of the upper casing section 2*a*.

Figure 3:
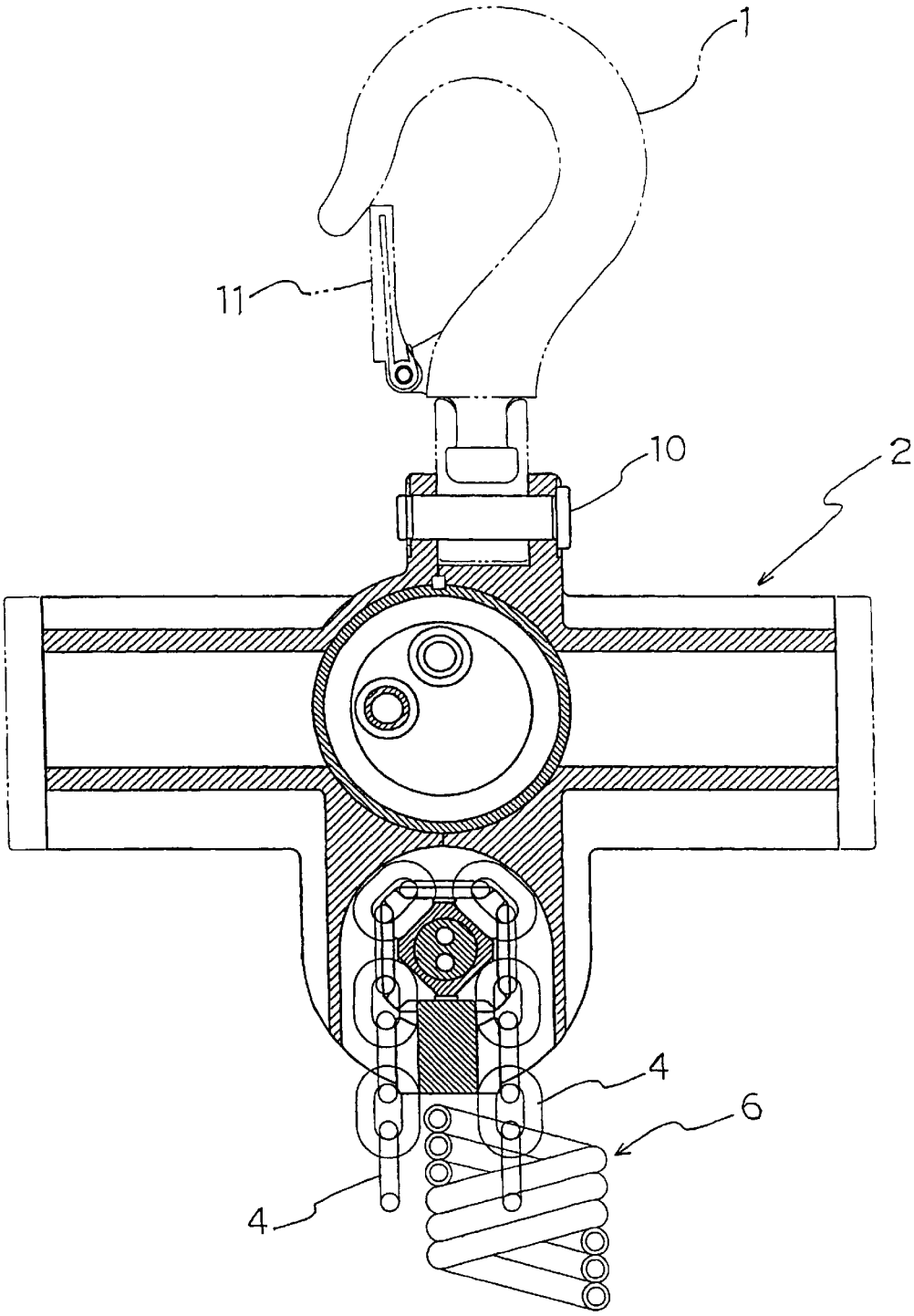
FIG. 3 is a sectional front view showing the pneumatic hoist apparatus in accordance with an embodiment of the present invention.

A gear 8*a* is disposed on the outer peripheral face of the chain sprocket 8 and a gear 24*a* is disposed on the outer peripheral face of the motor shaft 24. The gear 8*a* and the gear 24*a* have the same number of teeth and are disposed in mesh with each other. As the linear movement of each of the motor pistons 22 and 22 is converted into the rotational movement to rotate the motor shaft 24, the gear 24*a* is allowed to rotate in association with the rotation of the motor shaft 24 resulting in the rotation of the chain sprocket 8 in association with the gear 8*a* in mesh with the gear 24*a*. This can wind up or unwind the chain 4. The chain sprocket 4 may preferably be in a generally square form in section so as to be engage able with the chain 4 (see FIG. 3).

A portion of the lower casing section 2*b* with the chain sprocket 8 installed therein may also be used as a structuring element of a valve mechanism acting as a motor control unit for rotating the motor shaft 24 in normal and reverse directions which performs the rotational movement as the pneumatic motor M by controlling the supply and discharge of the air to and from the twin cylinders 23 and 23 acting as a main structuring element of the pneumatic motor M.

As shown in FIG. 4, the chain sprocket 8 is provided coaxially with a brake cylinder 80 at a one shaft end portion thereof and with a valve bush 81 at the opposite shaft end portion thereof. The brake cylinder 80 and the valve bush 81 comprise a portion of the lower casing section 2*b*.

To the shaft end portion of the chain sprocket 8 at the side of the brake cylinder 80, a brake disk 82 is fixed, and a brake shoe 83 is disposed in the brake cylinder 80 slidably in the axial direction so as to be in contact with the tapered peripheral surface of the brake disk 82 at the side of the valve bush 81. The brake shoe 83 is biased toward the brake disk 82 by the aid of a brake spring 84.

Further, a release piston 85 at the normal rotation side and a release piston 86 at the reverse rotation side are disposed in the brake cylinder 80 in a relationship spaced at a predetermined interval. The release piston 85 is located so as to form a cylinder chamber 90 for normal rotation in combination with the inner side surface of the brake cylinder 80. The release piston 86 at the reverse rotation side is located so as to interpose the brake disk 82 in association with the brake shoe 83. Moreover, a space interposed apart in the predetermined interval between the release piston 85 at the normal rotation side and the release piston 86 at the reverse rotation side can act as a cylinder chamber 91 for reverse rotation.

At the shaft end portion of the chain sprocket 8 at the side of the valve bush 81, there is provided a rotary sleeve 87 that has its outer periphery supported rotatably in the valve bush 81.

The chain sprocket 8 may be in a hollow form and a valve spool 88 is disposed in the hollow portion of the chain sprocket 8. A one shaft end portion of the valve spool 88 is supported by the inner peripheral portions of the release piston 85 at the normal rotation side and the release piston 86 at the reverse rotation side. On the other hand, the opposite shaft end portion of the valve spool 88 is supported by the inner peripheral portion of the rotary sleeve 87. The valve spool 88 is disposed so as to be slidable in the axial direction. The sliding movement of the valve spool 88 allows the opening or closing of a slit 87*a* at the normal rotation side and a slit 87*b* at the reverse rotation side, both being formed in the rotary sleeve 87.

As shown in FIG. 4, the valve spool 88 is provided with a first tubular path 88*a* and a second tubular path 88*b*, which are divided into upper and lower parts therein, and each extends therein over the entire length thereof. The first tubular path 88*a* is disposed communicating with the inlet 20 at the normal rotation side through the cylinder chamber 90 for normal rotation and the spool cylinder chamber 94 for normal rotation, the inlet 20 at the normal rotation side being connected to the operating unit 5 via the hose unit 6 and the spool cylinder chamber 94 being formed on the inner end face of the brake cylinder 80. The cylinder chamber 90 for normal rotation is disposed communicating with the spool cylinder chamber 94 through communicating passages 92 and 93. Further, the spool cylinder chamber 94 for normal rotation communicates with the first tubular path 88a through a passage 95. The spool cylinder chamber 94 for normal rotation is installed with a return spring 99 that allows the valve spool 88 to return to its neutral position.

The second tubular path 88*b* is disposed communicating with the inlet 21 at the reverse rotation side through the cylinder chamber 91 for reverse rotation. The second tubular path 88b is disposed communicating with the cylinder chamber 91 via communicating passages 97 and 98. Further, the opposite end of the second tubular path 88*b* communicates with the spool cylinder chamber 96 for reverse rotation disposed on the inner end face of the valve bush 81. The spool cylinder chamber 96 for reverse rotation is installed with a return spring 99 that allows the valve spool 88 to return to its neutral position.

Figure 7:
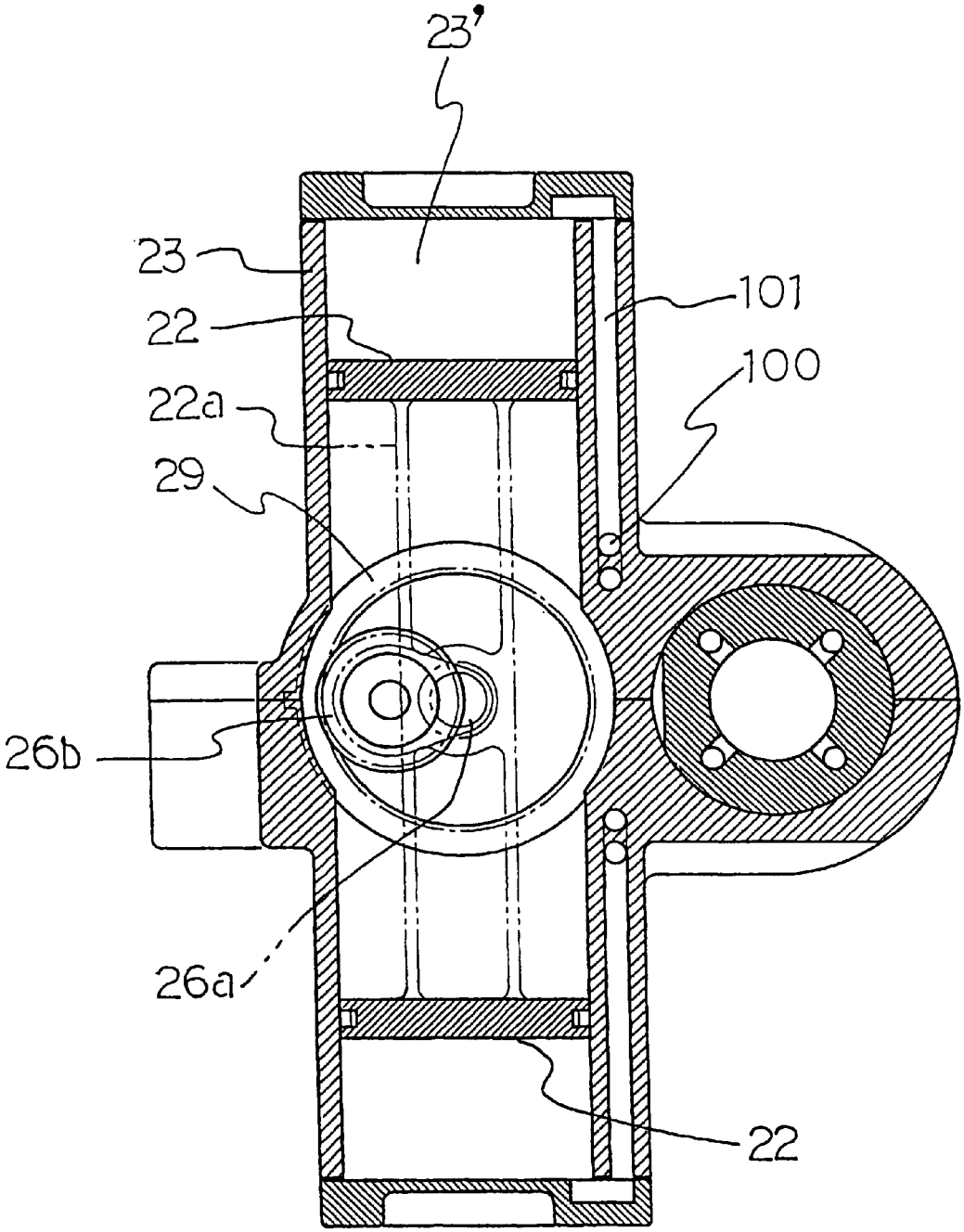
FIG. 7 Is a sectional view when taken along line I—I of FIG. 5.
Figure 8:
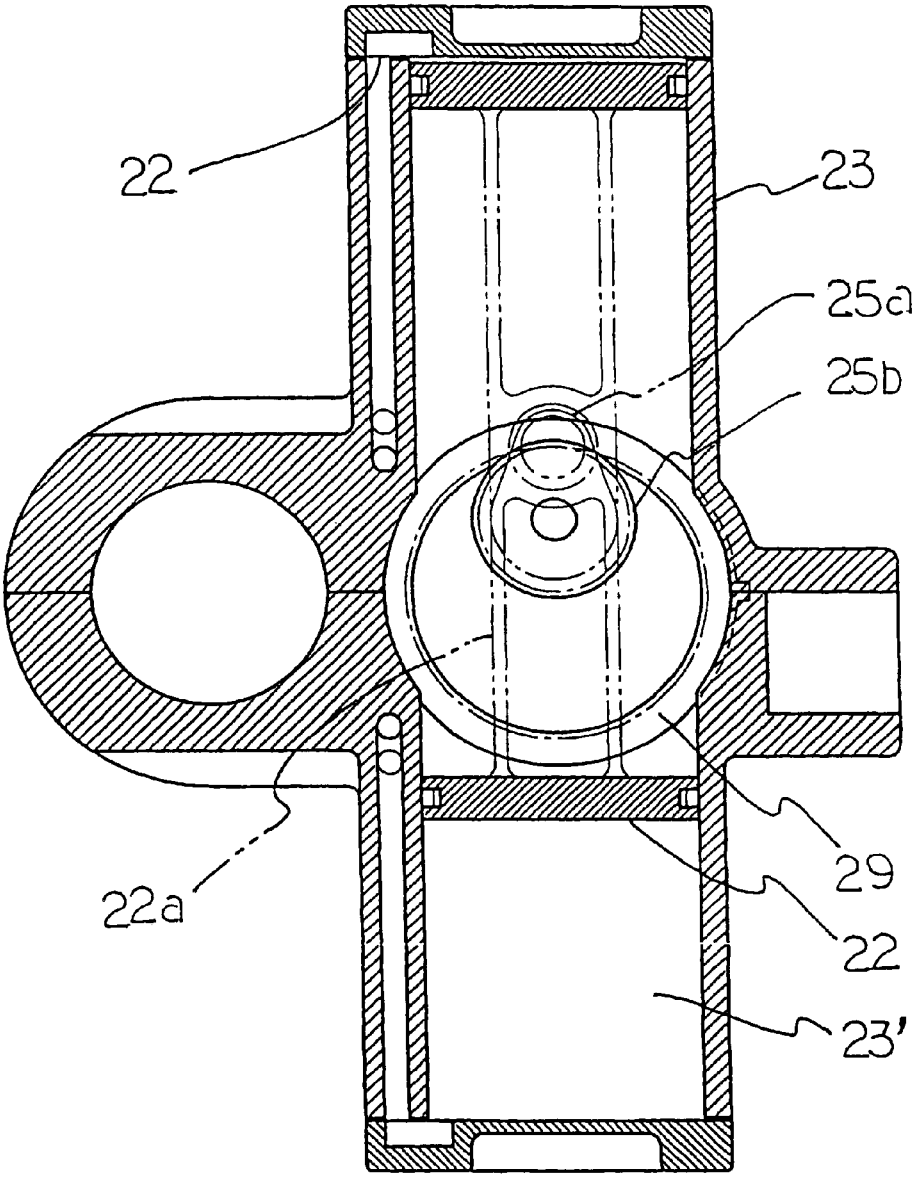
FIG. 8 is a sectional view when taken along line I—I of FIG. 5.
Figures 9A, 9B, 9C, 9D, 9E, 9F, 9G, 9H:
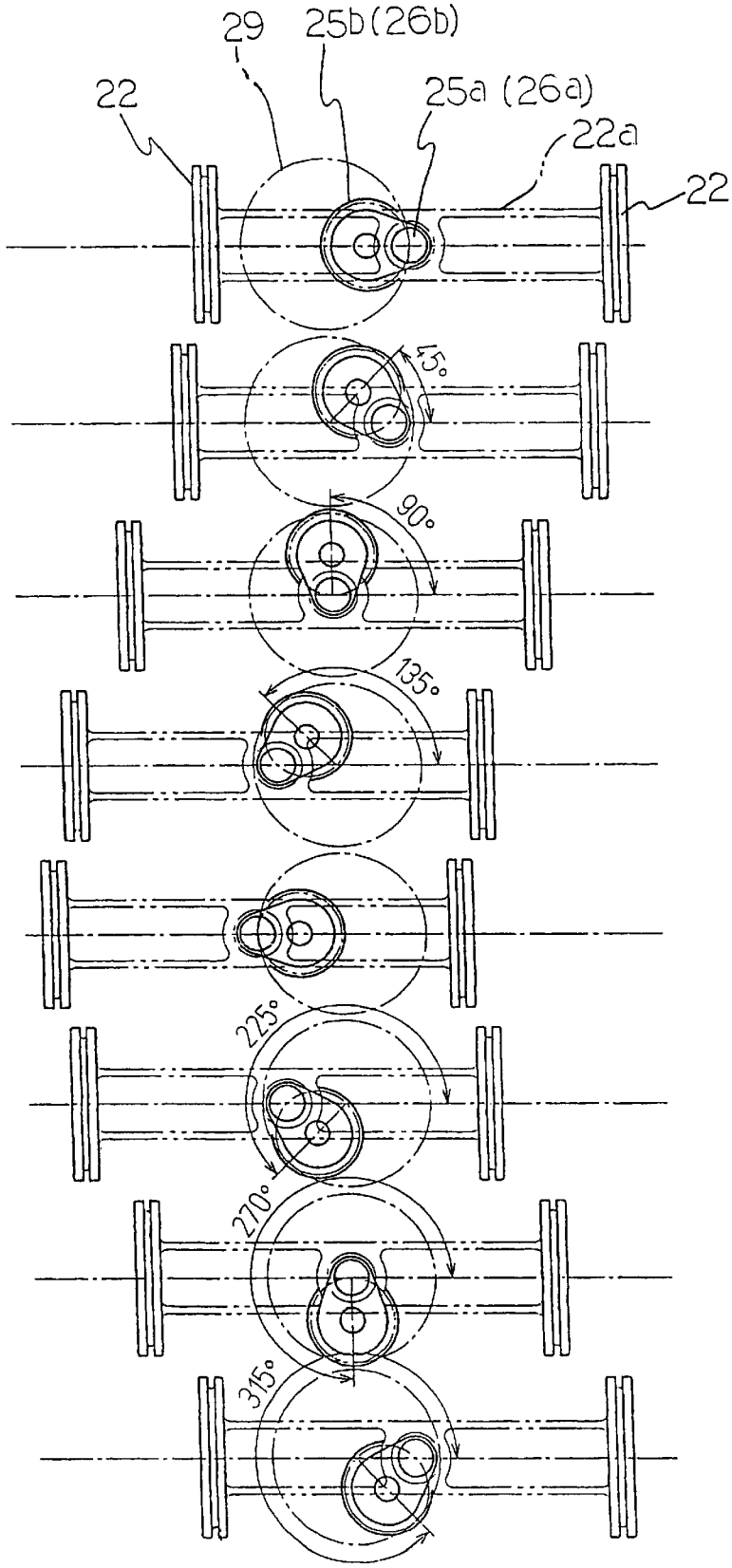

With the arrangements as described above, the high pressure air is supplied from the inlet 20 for normal rotation to the cylinder chamber 90 for normal rotation by operating the grip 52 of the operating unit 5 so as to move upward so that the release piston 85 at the normal rotation side is pressed by the pressure of the high pressure air. This allows the brake shoe 83 to be released or detached from the brake disk 82 by the aid of the release piston 86 at the reverse rotation side, thereby releasing the braking force. At the same time, the pressure flows into the spool cylinder chamber 94 at the normal rotation side through the communicating passages 92 and 93 and passes through the first tubular path 88*c* from the communicating passage 95 while pressing the valve spool right in FIG. 4 in resistance to the return spring 99 disposed in the spool cylinder chamber 96 at the reverse rotation side, followed by introducing into an outer peripheral groove 88*a* formed in the valve spool 88. At this time, the high pressure air is allowed to pass through the slit 87*a* at the normal rotation side of the rotary sleeve 87 opened on pushing the valve spool 88 to the right and flow in a port line 81*a* for normal rotation disposed in the valve bush 81, followed by introducing into a cylinder chamber 23' through communicating passages 100 and 101, as shown in FIG. 7, and rotating the motor shaft 24 in normal rotation direction by the thrust of the piston 22.

The piston 22 is installed at each end of a piston shaft 22*a* so that the pneumatic motor M is provided with four pistons 22. Therefore, each piston 22 for driving the pneumatic motor M shares a 90 portion as a rotating angle of the motor shaft 24. Therefore, as the rotating angle is replaced by a phase angle at which the top dead center of each piston 22 is set to be 0, the rotating angle is in the range of from 45 to 135, as shown in FIGS. 9*a*–9*h*.

As the piston 22 passes the vicinity of 135 as a rotating angle of the motor shaft 24, the supply of air to the cylinder chamber 23' is blocked by the rotary sleeve 87. Further, the piston 22 is pressed by its own expansion due to insulation to heat and simultaneously the other piston 22 disposed in the twin cylinders 23 has already been pressed by the high pressure air, so that the motor shaft 24 can be continued rotating.

Moreover, as the piston 22 approaches to the vicinity of the bottom dead center, the intermediate exhaust port 23*a* disposed in the cylinder 23 is opened to allow intermediate exhaust gases having high pressure, closed in the cylinder chamber 23', to be discharged into the outside from the intermediate exhaust port 23*a* through a passage 23*c* and an expansion chamber 23*b*.

As the motor piston 22 turns the bottom dead center and moves upon pressing the motor shaft 24, the intermediate exhaust port 23*a* is closed and the slit 87*b* for reverse rotation of the rotary sleeve 87 is opened, whereby the end exhaust gases pass through the slit 87*b* at the reverse rotation side via communicating passages 101 and 100 and are forced into an outer peripheral groove 88*d* for discharging exhaust gases of the valve spool 88. The end exhaust gases are then discharged into the outside through the slit 87*c* of the rotary sleeve 87, the communicating passages 200 and 201 as well as the expansion chamber 23*b*.

As the grip 52 of the operating unit 5 is returned to its neutral position, the high pressure air is blocked to reduce the pressure in the cylinder chamber 90 for normal rotation and the brake spring 84 pushes back the brake shoe 83, the release piston 86 at the reverse rotation side and the release piston 85 at the normal rotation side to operate the brake. At the same time, the return spring 99 disposed in the spool cylinder chamber 96 at the reverse rotation side pushes the valve spool 88 back to close the slit 87*a* at the normal rotation side of the rotary sleeve 87 and then suspend the operation of the motor shaft 24 for normal rotation.

On the other hand, as the grip 52 of the operating unit 5 is transferred downward, the high pressure air flows from the inlet 21 at the reverse rotation side into the cylinder chamber 91 for reverse rotation and the high pressure air depresses the release piston 86 at the reverse rotation side and the brake shoe 83, thereby detaching or releasing the brake shoe 83 from the brake disk 82 and releasing the braking force. Further, the high pressure air passes the first tubular path 88*b* through the communicating passages 97 and 98 and flows into the spool cylinder chamber 96 at the reverse rotation side, thereby transferring the valve spool 88 to the left in FIG. 4 in resistance to the return spring 99 disposed in the spool cylinder chamber 94 at the normal rotation side. The leftward movement of the valve spool 88 opens the slit 87*b* at the reverse rotation side of the rotary sleeve 87 to allow the high pressure air to flow into a port line 81*b* for reverse rotation disposed in the valve bush 81, thereby introducing the high pressure air into the cylinder 23 and thrusting the piston 22 in the direction opposite to the normal rotation to rotate the motor shaft 24 in the reverse direction.

As described above, the pneumatic motor M according to the present invention is of the type that can convert the linear movement into rotational movement by using a direct-acting cylinder motor as a drive source. Further, the pneumatic motor M utilizes the technology relating to a Cardan circle that, when the diameter of a pitch circle of a planetary gear (consisting the pinion gears 25*b* and 26*b*) is a half of the diameter of a pitch circle of an inner gear (consisting of the pinion gears 25*b* and 26*b*) in mesh therewith, the locus of a one point on the periphery of the pitch circle of the planetary gears gear (the pinion gears 25*b* and 26*b*) becomes linear. Therefore, the pneumatic motor M according to the present invention does not require a crank mechanism and a swash plate mechanism, so that no loss is caused due to abrasion by the reaction force acting on the outer periphery of the motor piston 22 and as a consequence mechanical efficiency can be improved.

Moreover, the pneumatic motor M according to the present invention is structured in such a manner that a mechanism for converting the linear movement into the rotational movement is arranged for each of the four pistons to equally share one rotation of the motor shaft 24 by a quarter thereof and that only the pressing pressure of each motor piston 22 is arranged so as to act onto the motor shaft 24 continually one after another. Therefore, the output torque (T) of the motor shaft 24 varies as represented by the following formula:

$$T=K(|\sin(a)|+|\sin(a+\pi/2)|)$$

where K is the proportional constant; and a is the rotational angle of the motor shaft.

Furthermore, the load torque imposed by goods or the like on the four-link chain 4 wound on the chain sprocket 8 also varies as represented by the above formula, so that a smooth rotational movement can be obtained by offsetting the variation in the load torque, thereby becoming likely to achieve stable characteristics of rotation at a crawling speed.

It is to be noted herein, however, that the present invention is not interpreted as being limited to the above embodiments in any respect and that the present invention encompasses every modifications and variations without departing from the scope and spirit of the invention.

EFFECTS OF THE INVENTION

The pneumatic motor and the pneumatic hoist apparatus installed with the pneumatic motor according to the present invention can achieve the following effects by their designed structures as described above.

The pneumatic motor according to the present invention in an aspect is configured such that the twin cylinders each having a piston disposed slidably therein and being arranged horizontally parallel to the axis thereof; the motor shaft interposed between the twin cylinders and arranged in a direction intersecting with the twin cylinders at a right angle; and the association system coupling the motor shaft to each piston and arranged so as to convert a linear movement of each piston into a rotational movement and transmit the rotational movement to the motor shaft; wherein the twin cylinders, the motor shaft and the association system are disposed integrally in the casing; the association system is coupled with the end portion of each of the first eccentric shaft and the second eccentric shaft, which in turn are disposed projecting from the motor shaft in opposite directions at a phase angle of 90 and coupled with the first eccentric pin and the second eccentric pin in an eccentric state, which in turn are coupled in association with the respective pistons; and pinion gears are disposed in mesh with the ring gear mounted integrally in the main casing body on the outer periphery of the first eccentric shaft and the second eccentric shaft, respectively. Therefore, the pneumatic motor according to the present invention can realize a motor of a piston type which is compact in size and low in manufacturing costs, which can improve efficiency in exhaust gases, and which can render noises low and ensure improved labor environment.

In a preferred embodiment of the present invention, the pneumatic motor can achieve a smooth rotational movement and stable characteristics of rotation at a crawling speed, in addition to the effects achieved as described above, by coupling the first eccentric shaft and the second eccentric shaft to the center of the piston shaft and having the both ends of the piston shaft installed each with the piston.

In a more preferred embodiment of the present invention, the pneumatic motor can further improve mechanical efficiency because no loss in abrasion is caused to occur due to the reaction force acting upon the outer periphery of the motor piston. In this embodiment, neither crank mechanism nor swash plate mechanism are required due to the configuration that the diameter of the pitch circle of the pinion gear disposed on each of the first eccentric pin and the second eccentric pin is set to double the amount of eccentricity from the motor shaft of each of the first eccentric shaft and the second eccentric shaft and that the axial center of the eccentric pin disposed on each of the first eccentric shaft and the second eccentric shaft is arranged to be located on the periphery of the pitch circle of the pinion gear.

In a more preferred embodiment of the present invention, the pneumatic motor can achieve a smooth motor rotation, in addition to the effects as achieved above, by arranging the axial center of one of the first eccentric pin and the second eccentric pin so as to reach the center of the pitch circle of the ring gear, too, when the axial center of the other eccentric pin reaches the periphery of the pitch circle of the ring gear.

In another aspect of the present invention, the pneumatic motor as configured above can provide the pneumatic hoist apparatus installed with the pneumatic motor, which can achieve stable characteristics of rotation at a crawling speed, save energy, lower noises, ensure improved and appropriate labor environment, and have high quality, particularly by the improved performance achieved by the pneumatic motor. The pneumatic hoist apparatus has the features in the configuration such that the motor control chamber is located under the twin cylinders, the motor shaft and the association system disposed in the casing; the motor control chamber is provided with the valve mechanism for rotating the pneumatic motor in normal and reverse directions by controlling the supply of air to the pneumatic motor and the discharge of air therefrom; and the chain sprocket coupled to the motor shaft through the gear is arranged parallel to the axis of the motor shaft and the chain with the four-link hook for hoisting goods or the like mounted at its bottom end is wound on the chain sprocket.

In a preferred embodiment of this aspect of the present invention, the pneumatic hoist apparatus can achieve improved operability, in addition to the effects as achieved by the above configuration, by arranging the remote operating section nearby above the lower hook of the chain, the remote operating section being for performing a remote control to rotate the pneumatic motor in normal or reverse directions or stop operations of rotating the pneumatic motor.

What is claimed is:

1. A pneumatic motor, comprising:

a motor shaft defining a shaft axis;

twin cylinders disposed horizontally adjacent in a direction parallel to the shaft axis and with the motor shaft interposed between said twin cylinders such that the shaft axis is aligned a direction intersecting said twin cylinders at a right angle;

pistons respectively slidably disposed in said twin cylinders;

an association system coupling said motor shaft to said pistons and converting a linear movement of said pistons into a rotational movement and transmitting the rotational movement to said motor shaft;

said twin cylinders, said motor shaft and said association system being disposed in a casing; and said association system including:

a first eccentric shaft and a second eccentric shaft rotatably mounted in and projecting from opposite ends of said motor shaft, said first and second eccentric shafts being eccentrically disposed relative to said shaft axis, and said first and second eccentric shafts being angularly displaced from each other by a phase angle of 90°;

said first and second eccentric shafts respectively having first and second eccentric pins disposed eccentrically relative to eccentric shaft axes of said first and second eccentric shafts, said first and second eccentric pins being coupled to respective ones of said pistons;

first and second ring gears disposed in said casing coaxially with respect to said motor shaft and at opposite ends thereof;

said first and second eccentric shafts respectively having first and second pinion gears on outer peripheries thereof, said first and second pinion gears being respectively meshed with said first and second ring gears;

said first and second pinion gears having a pitch circle diameter equal to double an amount of eccentricity from said shaft axis of each of said first eccentric shaft and said second eccentric shaft; and axial centers of said first and second eccentric pins being located on peripheries of pitch circles of said first and second pinion gears.

2. The pneumatic motor as claimed in claim 1, wherein the axial center of one of the first and second eccentric pins reaches a center of a pitch circle of a corresponding one of said first and second ring gears when the axial center of another one of the first and second eccentric pins reaches a periphery of a pitch circle of a corresponding other one of the first and second ring gears.

3. The pneumatic motor as claimed in claim 1, wherein:

said pistons each include a piston shaft and piston heads disposed on opposing ends of said piston shaft; and said first eccentric pin and said second eccentric pin are respectively coupled with a center of a corresponding one of said piston shafts.

4. The pneumatic motor as claimed in claim 3, wherein the axial center of one of the first and second eccentric pins reaches a center of a pitch circle of a corresponding one of said first and second ring gears when the axial center of another one of the first and second eccentric pins reaches a periphery of a pitch circle of a corresponding other one of the first and second ring gears.

5. A pneumatic hoist apparatus comprising:

a pneumatic motor including:

a motor shaft defining a shaft axis;

twin cylinders disposed horizontally adjacent in a direction parallel to the shaft axis and with the motor shaft interposed between said twin cylinders such that the shaft axis is aligned a direction intersecting said twin cylinders at a right angle;

pistons respectively slidably disposed in said twin cylinders;

an association system coupling said motor shaft to said pistons and converting a linear movement of said pistons into a rotational movement and transmitting the rotational movement to said motor shaft;

said twin cylinders, said motor shaft and said association system being disposed in a casing; and said association system including:

a first eccentric shaft and a second eccentric shaft rotatably mounted in and projecting from opposite ends of said motor shaft, said first and second eccentric shafts being eccentrically disposed relative to said shaft axis, and said first and second eccentric shafts being angularly displaced from each other by a phase angle of 90°;

said first and second eccentric shafts respectively having first and second eccentric pins disposed eccentrically relative to eccentric shaft axes of said first and second eccentric shafts, said first and second eccentric pins being coupled to respective ones of said pistons;

first and second ring gears disposed in said casing coaxially with respect to said motor shaft and at opposite ends thereof;

said first and second eccentric shafts respectively having first and second pinion gears on outer peripheries thereof, said first and second pinion gears being respectively meshed with said first and second ring gears;

said first and second pinion gears having a pitch circle diameter equal to double an amount of eccentricity from said shaft axis of each of said first eccentric shaft and said second eccentric shaft; and axial centers of said first and second eccentric pins being located on peripheries of pitch circles of said first and second pinion gears;

a motor control chamber including a valve mechanism for controlling supply of air to said twin cylinders to effect rotation of said motor shaft in normal and reverse directions; and a chain sprocket coupled to a gear on said motor shaft for accepting a chain for hoisting.

6. The pneumatic hoist apparatus as claimed in claim 5, further comprising:

a chain engaged with said chain sprocket and having a hook disposed at an end thereof; and a remote operating section disposed above the hook of the chain, the remote operating section including a remote control to rotate said pneumatic motor in normal or reverse directions or stop operations of rotating said pneumatic motor.

7. The pneumatic hoist apparatus of claim 5 wherein said motor control chamber is disposed beneath said twin cylinders.

8. The pneumatic hoist apparatus of claim 7 wherein said gear sprocket is disposed in said motor control chamber and drives said valve mechanism.

9. The pneumatic hoist apparatus as claimed in claim 8, further comprising:

a chain engaged with said chain sprocket and having a hook disposed at an end thereof; and a remote operating section disposed above the hook of the chain, the remote operating section including a remote control to rotate said pneumatic motor in normal or reverse directions or stop operations of rotating said pneumatic motor.

10. The pneumatic hoist apparatus as claimed in claim 7, further comprising:

a chain engaged with said chain sprocket and having a hook disposed at an end thereof; and a remote operating section disposed above the hook of the chain, the remote operating section including a remote control to rotate said pneumatic motor in normal or reverse directions or stop operations of rotating said pneumatic motor.

* * * * *